US005356333A

United States Patent [19]

Bointon et al.

[11] Patent Number: 5,356,333

[45] Date of Patent: Oct. 18, 1994

[54] COIN STORAGE DEVICE

[75] Inventors: Richard G. Bointon, Caversham; John J. Comfort, Basingstoke, both of United Kingdom

[73] Assignee: Mars, Inc., McLean, Va.

[21] Appl. No.: 847,015

[22] PCT Filed: Oct. 4, 1990

[86] PCT No.: PCT/GB90/01526

§ 371 Date: Jul. 15, 1992

§ 102(e) Date: Jul. 15, 1992

[87] PCT Pub. No.: WO91/06073

PCT Pub. Date: May 2, 1991

[30] Foreign Application Priority Data

Oct. 12, 1989 [GB] United Kingdom ..... 8923006.4

[51] Int. Cl.[5] ..... G07D 1/00

[52] U.S. Cl. ..... 453/40; 221/75; 453/49

[58] Field of Search ..... 453/40, 49, 57; 194/342, 343; 221/75

[56] References Cited

U.S. PATENT DOCUMENTS

| | | | |
|---|---|---|---|
| 1,625,979 | 4/1927 | Brinkerhoff | 453/49 |
| 3,948,377 | 4/1976 | Hayashi . | |
| 4,167,949 | 9/1979 | Hashimoto et al. . | |
| 4,360,034 | 11/1982 | Davila et al. . | |
| 4,527,577 | 7/1985 | Miller et al. | 453/57 X |
| 4,559,958 | 12/1985 | Wingerter | 453/57 |
| 4,836,825 | 6/1989 | Smeets et al. | 453/40 X |

FOREIGN PATENT DOCUMENTS

| | | | |
|---|---|---|---|
| 0000010 | 12/1978 | European Pat. Off. . | |
| 1957092 | 3/1971 | Fed. Rep. of Germany . | |
| 3307438 | 9/1984 | Fed. Rep. of Germany | 194/342 |
| 2135654 | 12/1972 | France . | |
| 2293749 | 7/1976 | France | 194/343 |
| 442406 | 2/1936 | United Kingdom . | |
| 992911 | 5/1965 | United Kingdom . | |
| 1456532 | 11/1976 | United Kingdom . | |
| 2047936 | 12/1980 | United Kingdom . | |
| 2070307 | 9/1981 | United Kingdom . | |
| 2088108 | 6/1982 | United Kingdom . | |
| 2097165 | 10/1982 | United Kingdom . | |
| 2124814 | 2/1984 | United Kingdom . | |
| 2135094 | 8/1984 | United Kingdom . | |
| 2201823 | 9/1988 | United Kingdom . | |

*Primary Examiner*—F. J. Bartuska
*Attorney, Agent, or Firm*—Davis Hoxie Faithfull & Hapgood

[57] ABSTRACT

A coin handling system includes two coin escrows which receive respectively high and low denomination coins. Each escrow comprises a helical structure with coins individually supported between successive turns of the helix. Each helical structure can store coins of any denomination in any location, and has exits at both ends to allow control over the sequence in which the coins are sent to a cash box.

22 Claims, 6 Drawing Sheets

2
4
6
8
10
12
14
16
17
18
19
20
22
24
26
28
30
32
34
36

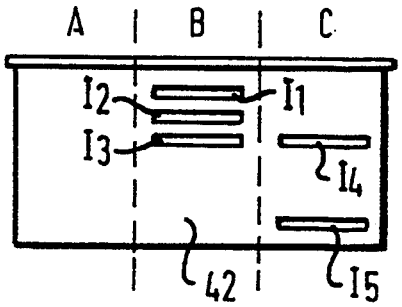
FIG.5(a)
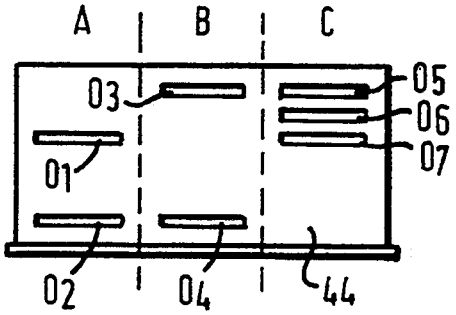
FIG.5(b)
FIG.6(a)
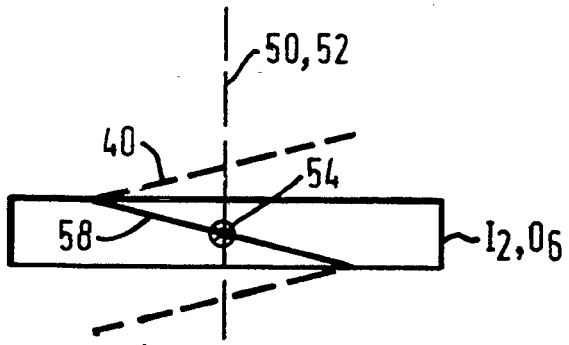
FIG.6(b)
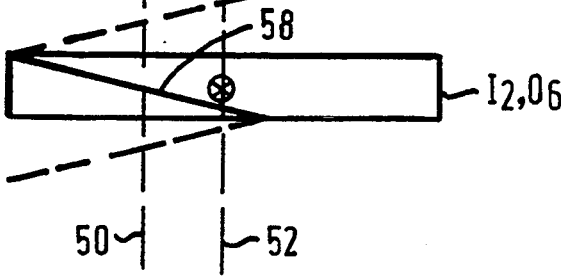

COIN STORAGE DEVICE

FIELD OF THE INVENTION

This invention relates to coin stores, and is particularly but not exclusively concerned with coin escrows, which are stores used, e.g. in payphones, for temporarily retaining coins before dispensing them so that they can either be retained in a cash box or refunded to a user.

It is desirable in such arrangements to enable selection of the coins to be refunded to the user, so that the amount of change given to the user after a transaction (e.g. after a phone call) can be maximised. It would also be desirable to allow selected coins to be delivered to a cash box during the transaction if the store becomes filled, so as to permit the insertion of further coins.

It would be possible to use an arrangement such as that shown in GB-A-2201823, wherein there is a structure storing the coins in respective compartments. The structure can move the compartments successively past an openable exit region so that the coins could be selectively dispensed as desired. However, this arrangement is wasteful of space, because additional space is needed to allow for the lateral movement of the structure.

A more compact storage arrangement is shown in GB-A-2135094, in which coins can be stored in successive turns of a spring. Coins are dispensed to a cash box by turning the spring so that the coins move stepwise to a sorter where the coins are allowed to leave the spring at different positions, depending on their diameter. At the other end of the spring is an exit path from which coins can be delivered to a return channel. However, this arrangement allows little control over the sequence in which coins are sent to the cash box, this sequence being dependent mainly on the order in which the coins are received by the spring and the respective coin diameters.

It would therefore be desirable to provide an improved storage device which is compact and has low power consumption, and which is arranged to enable the dispensing of coins in a selectable sequence different from that in which they were received by the store.

SUMMARY OF THE INVENTION

According to one aspect of the present invention, there is provided a coin store in which a group of coins of different denominations can be reciprocated with respect to first and second exit points at each of which a coin of any of said denominations can be taken away from the group and delivered to a cash retention means, whereby the sequence in which coins are delivered to the cash retention means can be controlled by selectively moving the coin group in one direction to dispense a coin from the first exit point, and the opposite direction to dispense a coin from the second exit point. By selecting the exit point from which to take a coin, the order in which the coins are dispensed can be controlled so that the dispensing sequence differs from the entry sequence. The dispensed coins from both exits are preferably routed to a coin retention means, e.g. one or more cash boxes. Preferably the coins are stored face-to-face for compactness, and preferably individually to facilitate the addition or removal of a coin from the group.

The invention is particularly advantageous when applied to a storage arrangement of the type in which coins can be reciprocated as a group without requiring bodily translational movement of the storage structure (e.g. the type shown in GB-A-2135094). In this way there is provided the advantage of a compact structure combined with a greater ability to control the dispensing sequence. Preferably, therefore, a coin store of the invention comprises a helical structure for receiving coins of a plurality of denominations and storing them between successive helical turns so that they can be moved, by rotation of the structure, relative to two exit points at which a coin of any of said denominations can be added to or taken away from the store.

Particular benefits are obtained if the exits are located at opposite ends of a region in which the coins are stored, and wherein there is a coin entry point located at or near one of these ends. Such an arrangement enables a choice of coins to be dispensed from the store, while ensuring that any space which is freed by this dispensing can be replenished by a further coin from the entry. By this means, it is possible to maximise the benefits of the compact type of storage structure mentioned above.

If desired there may be a gate or other means for selectively directing a coin from one of the exits either to the cash retention means or a refund path. Alternatively, the store has a third exit leading to a refund path.

Preferably, the store has a control means which selects coins for dispensing from the store according to the values of-the coins. The control means may also take into account the positions of the coins within the store, particularly if only certain coins are available for dispensing in dependence upon their position.

The invention also extends to a coin handling apparatus including a coin validator and a coin store according to the invention positioned to receive coins from the validator. Preferably, the system has two or more such stores, and the validator may be arranged to deliver coins selectively to either store. This enables a greater volume of coins to be stored, and a greater degree of choice in the selective dispensing of the coins. The system is preferably arranged to control the store to which coins are directed in dependence upon the value of the coins as detected by the coin validator; if for example high denomination coins are directed to one store and low denomination coins to the other store, this will improve the likelihood that a coin of approximately the right denomination will be available for dispensing. In addition, the system is preferably arranged to detect a fault in either one of the stores, and in response thereto to disable that store, so that the system may continue functioning correctly using only one of the stores.

Some aspects of the above technique are considered to be independently inventive and advantageous. Thus, in accordance with a further aspect of the invention, there is provided a method of controlling a coin handling system having a coin validator for use with coins of a range of denominations and two or more coin stores each of which is capable of receiving and storing coins of any of said denominations from the validator, the method comprising selecting the store to which coins are to be delivered in dependence upon the values of the coins, such that a first of the stores retains predominantly low-denomination coins and a second of the stores retains predominantly high-denomination coins.

DESCRIPTION OF THE DRAWINGS

An arrangement embodying the invention will now be described by way of example with reference to the accompanying drawings, in which:

FIGS. 5(*a*) and 5(*b*) are schematic views illustrating the way in which the tubes forming the gate arrangement of the store are configured;

FIGS. 6(*a*) and 6(*b*) are schematic plan views of the coin entry;

DETAILED DESCRIPTION

Figure 1:
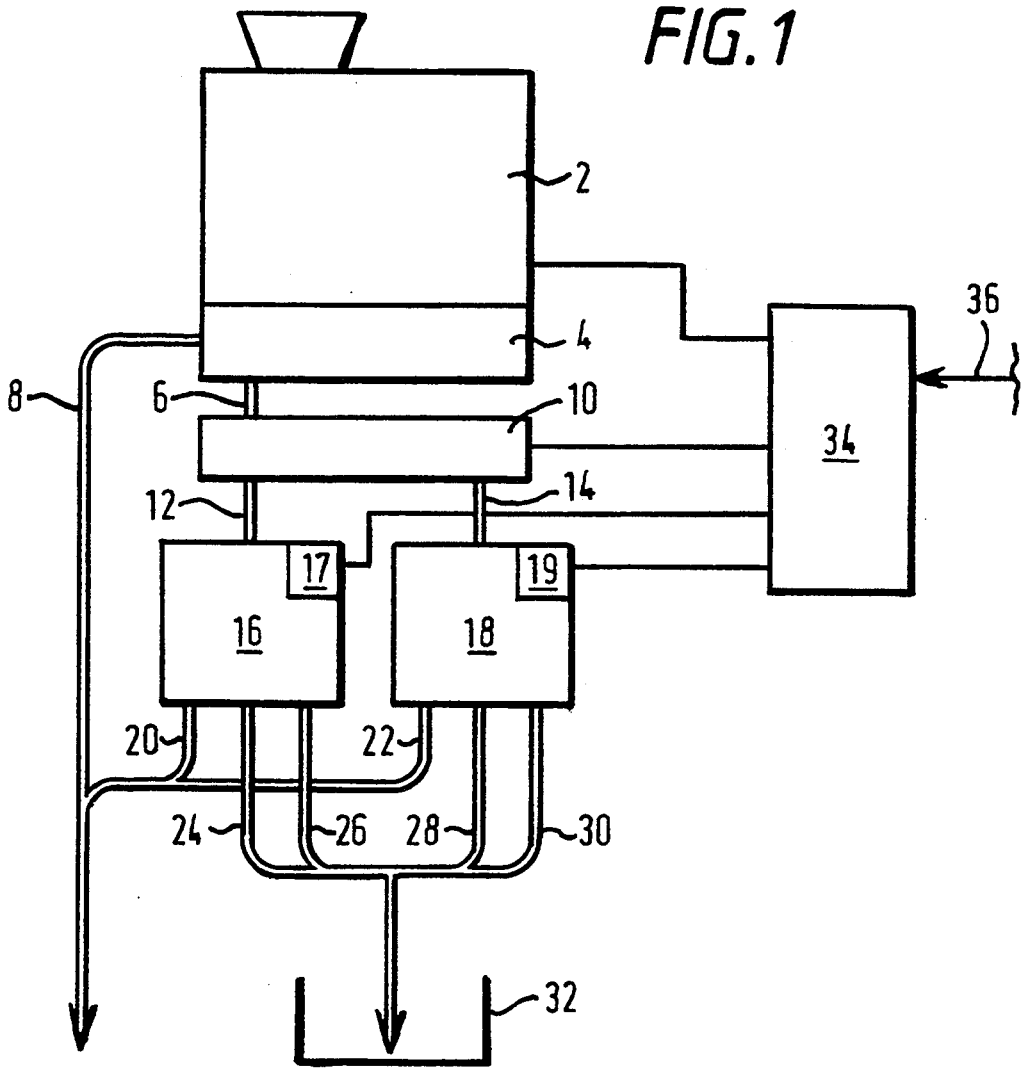
FIG. 1 is a schematic view of a coin handling system using coin stores according to the invention.

Referring to FIG. 1, a coin validator 2 of known form, preferably using electronic circuitry for validating coins while they are travelling down a coin path, has at its exit an accept gate mechanism 4. If the coins are deemed acceptable, they are delivered to an accept path 6. Otherwise, they are delivered to a reject path 8, which returns the coins to the user. The accept path 6 leads to a sorter 10 which selectively directs the coins to a first routing path 12 or a second routing path 14 leading, respectively, to coin stores 16 and 18.

Each of the coin stores has a refund path 20 and 22, respectively, which direct coins dispensed by the coin stores to the reject path 8, and thus back to the user. Each store also has two cash box paths, the paths for store 16 being indicated at 24 and 26, and those for store 18 at 28 and 30, all of which lead to a coin retention means in the form of a common cash box 32. Separate cash boxes could be used instead, if desired.

A control means 34 responds to signals from the validator 2 by controlling the accept gate 4 to cause genuine coins of known denomination to travel along accept path 6 to the sorter 10. The control means determines whether the coin should then be directed along path 12 or path 14 in dependence upon the denomination of the coin as detected by the validator 2. Low denomination coins are delivered to the store 16, and high denomination coins to the store 18. If either store is full, the control means 34 is arranged to cause further coins to be directed to the other store, irrespective of denomination. The control means 34 is able to send a signal to the validator 2 to cause it to reject all coins, and therefore deliver them to the refund path 8, if both the stores 16 and 18 are full.

The control means 34 has a memory which stores information indicating what coins are presently in the stores 16 and 18, and their positions within the stores. This information also indicates which of these coins are presently positioned so that they are available for dispensing along one of the cash box paths 24 to 30.

The system is particularly suited for installation in a machine, such as a payphone, where the cost of any transaction is not determinable at the beginning of the transaction, and possibly where it increases in a progressive manner during the course of the transaction. The control means 34 causes the stores 16 and 18 to deliver to the cash box 32 coins which have a total value equal to or greater than the value of the transaction, and delivers the remaining coins as change along the refund paths 20 and 22. The control means 34 is arranged to select the coins which are retained and dispensed in such a manner that the change given to the user is greater than that which would be available if the coins were simply retained in the order in which they were inserted, and is preferably maximised having regard to the constraints of the system. Preferably, coins are delivered to the cash box 32 one-by-one during the course of the transaction. One way in which this may be achieved would be for the control means to receive a signal on line 36 from the host machine, e.g. the controller of the payphone, indicating the expenditure of credit. At the point at which this is equal to the value of the highest-value coin presently in the stores 16 and 18, the control means 34 would cause the highest-value coin presently available for dispensing (and probably stored in store 18) to be dispensed to the cash box 32. The amount of the expended credit would be reduced accordingly, and the operation would continue, so that the next coin would be dispensed when the current expenditure again increased to the amount corresponding to the highest-value coin in the stores 16 and 18. Of course, this routine can be varied in a number of ways. For example, dispensing may be triggered at the point at which the expended credit is equal to the value of the highest-value coin actually available for dispensing.

At any time, the user can insert coins to replenish the stores 16 and 18. Preferably, the control means is arranged to control the stores 16 and 18 so that the spaces becoming vacant as a result of the dispensing of coins can be filled by newly-inserted coins.

At the end of the transaction, the control means causes the delivery to the cash box 32 of coins equal to or exceeding in value the current amount of expended credit. The selection of the coins to be dispensed from the stores 16 and 18 is controlled so that the amount by which the value of the coins directed to the cash box 32 exceeds the current expended credit is minimised. For this purpose, it is desirable to have available low-value coins, which would normally be in the store 16.

It will be appreciated that, by directing high-value coins predominantly to store 18 and low-value coins predominantly to store 16, the ability of the control means to select predominantly high-value coins to be directed to the cash box 32 during the transaction and low-value coins to be used at the end of the transaction to increase the amount of change available is greatly facilitated, without placing restrictions on the order in which the user must insert coins.

The construction of the store 16 will be described in more detail with reference to FIGS. 2 to 6. The store 18 is of identical structure.

Figure 3:
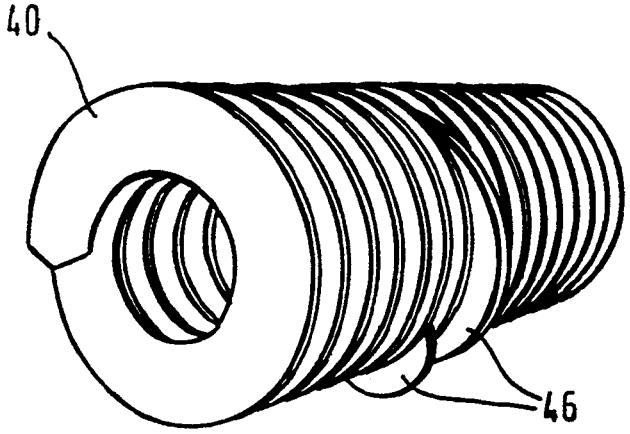
FIG. 3 shows the helical structure of the store.

The store 16 comprises a helical member 40, also referred to herein as a helix, having a horizontal axis. This is located within an inner tube 42, which is itself located within an outer tube 44, both tubes also having horizontal axes. In use, each coin received from the sorter 10 falls through aligned apertures in the inner and outer tubes 42 and 44 and enters a space between successive turns of the helical member 40. A motor (not shown) is provided to rotate the helix, which will cause translatory movement of the coin in the direction of the axis of the helix. Thus, the coins can be moved successively along the helix to make room for more coins received via the entry. FIG. 3 shows two coins 46 positioned within successive turns of the helix. It will be noted (a) that the coins are in a face-to-face orientation, thus enabling a fairly compact structure, (b) that the coins may be of different denomination and substantially different sizes, but nevertheless be positioned reliably, and (c) that the coins are retained in individual sections, rather than engaging each other, which will facilitate the individual dispensing of the coins to be described later.

Figure 2:
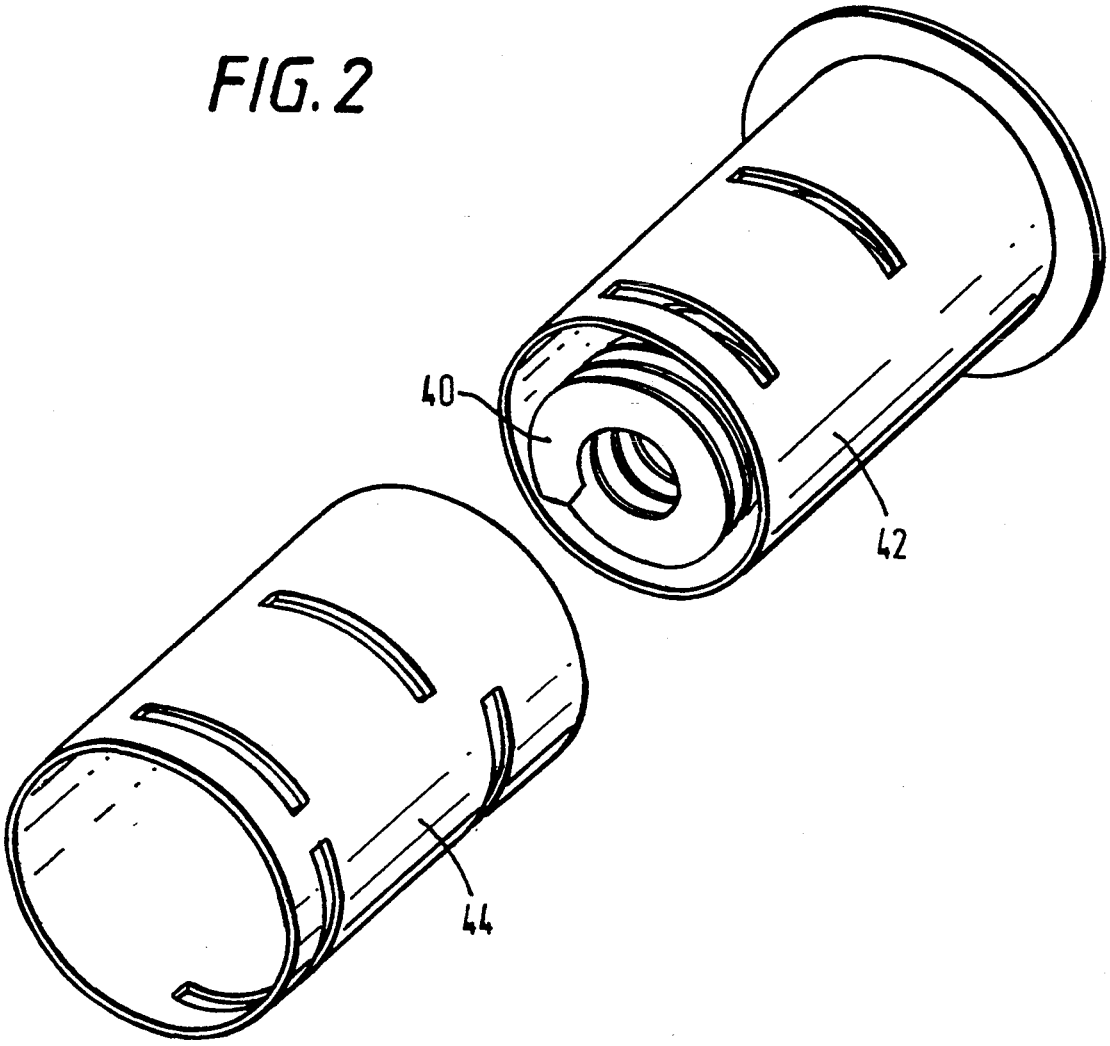
FIG. 2 is a partially-exploded view of one of the coin stores.

Referring particularly to FIG. 2, the tubes 42 and 44 have apertures at selected positions, and these selectively provide access to particular regions of the helix 40. By independently rotating the inner and outer tubes 42 and 44, pairs of apertures can be brought into registry with selected locations in the helix so as to provide access points for permitting coins to enter or exit the store.

In the particular example to be described, there are eight usable locations within the helix 40, each location being disposed between successive turns of the helix. These are represented schematically in FIG. 7. The apertures in the tubes 42 and 44 are so located as to provide an entry access point at location 7, and exit access points at locations 1, 6 and 8. This is achieved by grouping the apertures into three circumferential sections in each of the tubes 42 and 44, in the manner illustrated in FIGS. 5(*a*) and 5(*b*) which show schematically the positions of the apertures as represented on flattened-out versions of the tubes.

In the normal orientations of the tubes, sections A are both positioned directly beneath the helical member 40. As the section A of inner tube 42 has no apertures, this provides a smooth surface permitting the coins to ride along the surface as the helix rotates and the coins move.

Rotating both tubes by 120° will bring sections B directly underneath the helical member 40. This will result in aperture I1 in inner tube 42 being in registry with aperture O3 in outer tube 44, both the apertures being located beneath location 8 of the member. This provides an exit path at location 8 leading to the refund path 20.

By positioning section B of inner tube 42 and section A of outer tube 44 directly beneath the helical member 40, apertures I3 and O1 become aligned. This provides an access point at location 6, which leads to the cash box path 24.

By positioning section C of inner tube 42 and section B of outer tube 44 beneath the helical member 40, apertures I5 and O4 are aligned beneath location 1, providing an access point to cash box path 26.

By positioning sections B and C of tubes 42 and 44 respectively beneath the helical member 40, access points are provided to both the cash box path 24 and the refund path 20. The registry of apertures I2 and 06 will also provide access to location 7, but this is not used as an exit location and no exit path is provided here. Access is provided simultaneously to cash box paths 24 and 26 by positioning sections C and A of tubes 42 and 44, respectively, beneath the helical member 40.

It will be understood from the above by selectively positioning each of the tubes in any one of three locations spaced by 120° about the tube axis, access can be provided to any one of the exit locations 1, 6 and 8, leading to cash box paths 26 and 24 and refund path 20, respectively. Also, access can be provided simultaneously to exit locations 1 and 6, and exit locations 6 and 8.

It is desirable to allow coins to enter and leave the helical member 40 under the force of gravity. For this reason, both the entrance and the exit paths are substantially vertical at the access points to the helical member. Because the tubes 42 and 44 have an odd number of sections, the tube positions which are appropriate to locate the sections directly underneath the helical member will be inappropriate for locating those sections directly above the member. In order to provide an access point for entry of the coins to location 7, section B of inner tube 42 and section C of outer tube 44 have to be located directly above the helical member, so that apertures I2 and 06 are in registry with location 7. In addition therefore to the three tube positions required to provide the exit paths, there is also an intermediate position for each tube to provide an access point at the entry location. For simplicity, each tube is movable in steps of 60° about its axis. This permits each tube to be located at the desired positions to allow indexing of the coins within the tubes or exit of selected coins, and in addition permits each tube to be positioned in the intermediate location required for entry of a coin.

Figure 4:
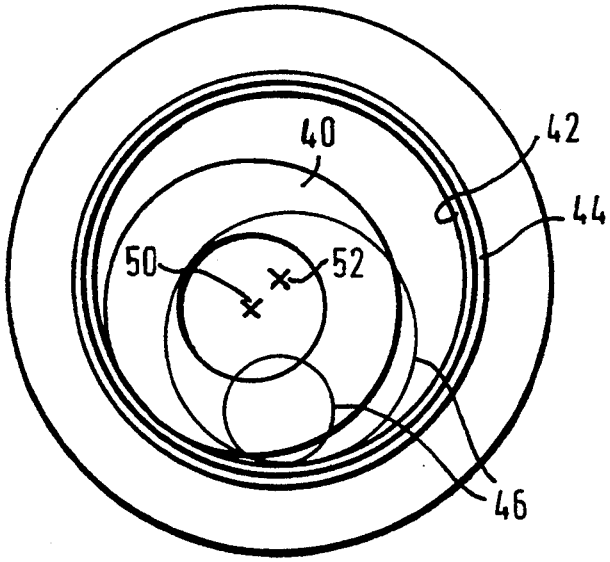
FIG. 4 is a side elevation of the coin store.

Referring to FIG. 4, it will be noted that the axis 50 of the helical member 40 is displaced from the axis 52 of the two co-axial tubes 42 and 44. The axis 50 is displaced vertically so as to ensure support even for the smaller coins which rest upon the inner surface of the tube 42. The horizontal displacement will be explained with reference to FIG. 6. FIG. 6(*a*) shows in plan view the position of the part 58 of the helical member 40 located under the apertures I2, 06 providing access at the coin entry, assuming that the axis 50 of the helical member 40 were to be located in the same vertical plane as the axis 52 of the tubes 42 and 44. An incoming coin will enter vertically downwardly as indicated at 54. The lowermost part of this part 58 of the helical member 40 will be located directly beneath the coin entry path, and therefore the coin could come to rest at either side of the part 58. This means that the location of the coin will be to some extent indeterminate.

As shown in FIG. 6(*b*), by horizontally displacing the axis 50 of the helical member 40 from the axis 52, an incoming coin will be reliably placed between a predetermined pair of turns of the member, so as to avoid this problem.

Figure 7:
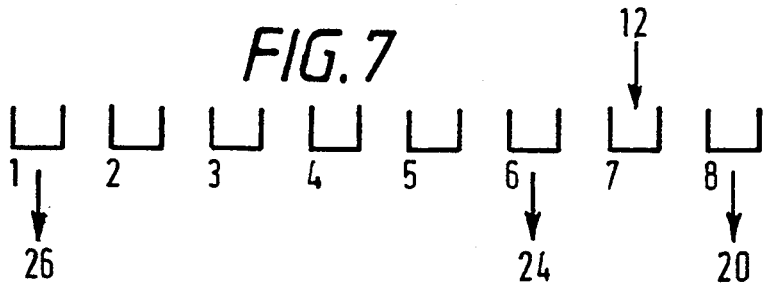
FIG. 7 schematically illustrates the locations in the store at which coins can be retained.

The locations within the helical member 40 as shown in FIG. 7 are evenly spaced at the pitch of the helix. The motor driving the helical member is arranged to rotate it by 360° in order to index the coins along the member, i.e. to move them stepwise by one location. To enable reliable access to a downwardly-extending exit path, the helical member is positioned with the part which is in the centre of each location at the uppermost point. As indicated in FIG. 6, to allow reliable entry of a coin, the part 58 which is in the centre of the location must be at the lowermost point. Accordingly, in addition to rotating the helical member by 360°, the motor must also be capable of rotating it by 180° in order to prepare the member for reception of a coin via the entry access point. After entry of the coin, the motor is rotated in the reverse direction by 180°.

The motors driving the helical member 40 and the tubes 42 and 44 may be stepper motors. Alternatively, or additionally, sensors may be provided for indicating whether or not the driven member or tube has reached any of its desired locations. The tubes 42 and 44 may form extensions of the armatures of their respective motors.

Means 17 and 19 (shown in FIG. 1) are provided for sensing a fault condition in either of the stores 16 and 18.

Such means 17 and 19 can take the form of a jam detector specifically designed for this purpose. Alternatively, the position sensors used to detect the location of the helical member and thus control its rotation may also be used for this purpose. In particular, a fault could be indicated if the position sensor indicates that the selected position has not been adopted within a predetermined time of energising the motor. Fault conditions are signalled to the control means 34. Once a fault condition is detected in one of the stores, further coins are routed only to the other store. The control means will issue the signal causing the validator to reject all coins whenever the remaining store is full.

Although these precautions enhance the reliability of the system, it should be noted that the design of the stores, including the helix, is inherently reliable. Because each coin is individually and positively driven when it is moved, jamming due to faceted, wet or dirty coins is less likely to occur. Also, it is possible to attempt to clear suspected jam conditions by reversing the direction of rotation of the helix, rotating the inner tube, etc. If desired, the machine can be arranged automatically to operate the store, e.g. by rotating the helix when no coin is present in the system, to flush out any debris that may have accumulated, which would then be delivered to the refund path.

Figure 8:
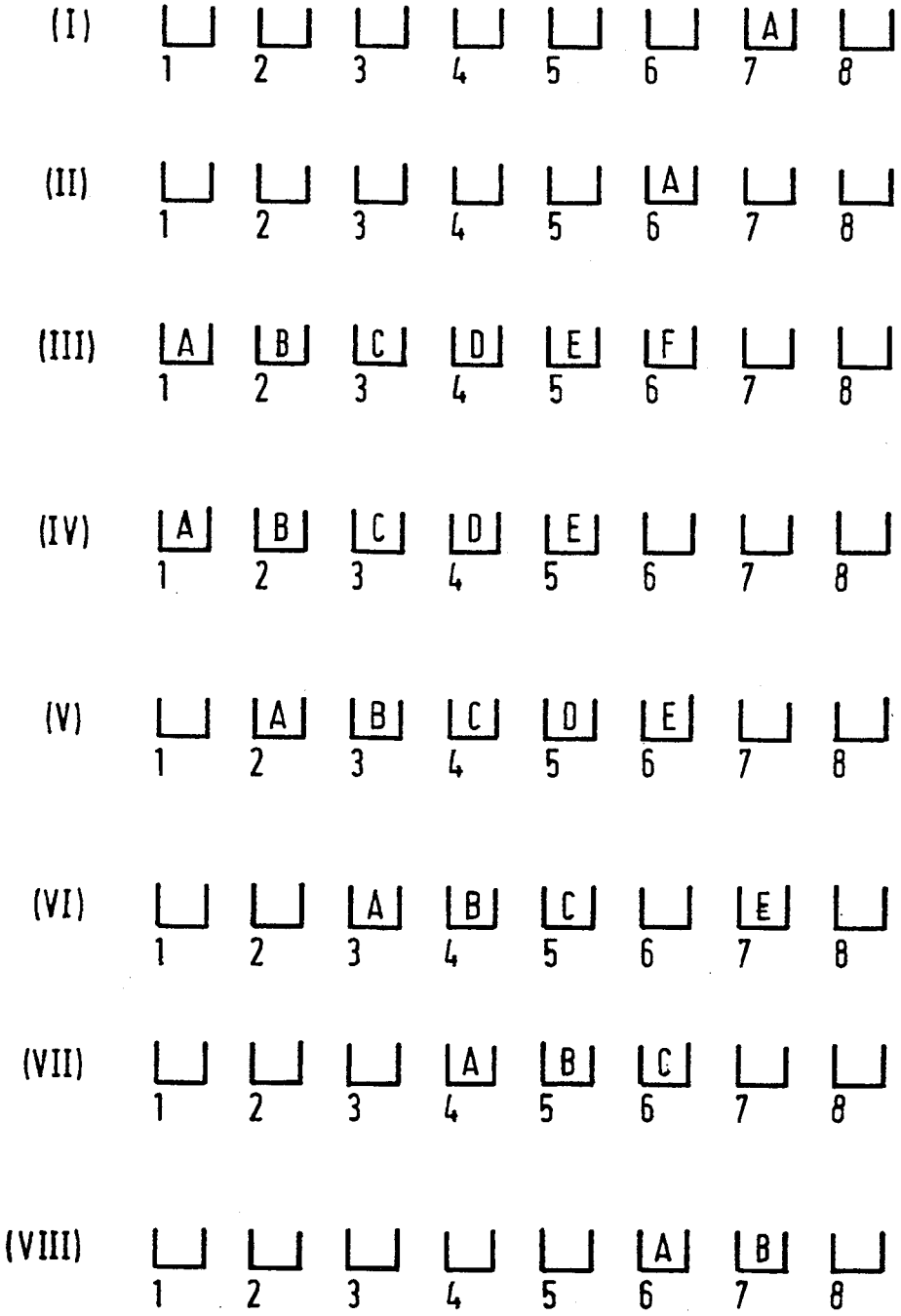
FIG. 8 illustrates an example of how the store can be controlled during the reception and dispensing of coins.

FIG. 8 illustrates one example of a way in which the control means 34 may operate the store 16 during the course of a transaction. FIG. 8(I) shows the state of the store after the first coin A has been received. Immediately after reception, the helical member is rotated to shift the coin to location 6 to leave location 7 free for the next coin, as shown in FIG. 8(II).

Assuming that six coins A to F have been entered, then the store adopts the state shown in FIG. 8(III). It will be noted that the group of coins progressively fills the store starting at location 6 and ending at location 1.

In the embodiment described herein the control means assumes that only the endmost coins, in this case A and F, are available for dispensing to the cash box during the course of a transaction. The paths to the cash box are at locations 1 and 6, so that the endmost coins can always be dispensed from one or other of these locations, if necessary by shifting the coins along so that the left-most coin reaches location 1.

It will be understood that this could easily be modified. For example, with reference to FIG. 8(III), it will be understood that the helical member could shift the coins along by two locations to the right, so that coins D and E could also be considered available for dispensing from location 6.

When the control means 34 detects that a coin is to be dispensed, it checks which of the available coins in both stores has the highest-value. Assuming that this is coin F, then the coin is dispensed so that the store adopts the state shown in FIG. 8(IV). The coins are then indexed to the position shown in FIG. 8(V), so that there will be no gaps between these and any further coin which may be inserted.

At the end of the transaction, the control means 34 determines which of the coins presently contained in the store should be retained, and which refunded, in order to ensure that sufficient value is given by the user, but that the value of his change is maximised. There are no restrictions on which of the coins can be refunded and which retained, as explained below.

In the present case, assuming that only coin D is to be retained, then this is achieved first by indexing the coins to the right, and then by opening the access point at location 6, as shown in FIG. 8 (VI).

The coins are then indexed again to the right, so that coin E reaches location 8, at which it is refunded as shown in FIG. 8(VII). The coins are then indexed twice to shift coin C to location 8, where it is refunded as shown in FIG. 8(VIII). The process is then repeated for coins A and B.

In this example, the coins are kept together in a group which is maintained within a region having cash box exits at each end thereof. In addition, the refund exit is located outside this region. This means that at least the endmost coins in the group can be dispensed to the cash box during the course of the transaction. At the end of the transaction, the coins can all be stepped past one of the cash box exits to reach the refund exit. Accordingly, any one of the coins can be directed to the cash box, or can stay in the store until it reaches the refund exit, where it is refunded. This arrangement therefore provides a very flexible technique for controlling the destinations of the coins.

Other arrangements are possible. For example, instead of depositing the coins in the store in the order in which they are inserted, they could be rearranged by suitable control of the store at the time the coins enter. There could be several entry points.

An alternative embodiment of the invention corresponds to that set out above, except that the structure of the coin stores as described with references to FIGS. 2 to 7 is modified as will now be described with reference to FIGS. 9 and 10.

Figure 9:
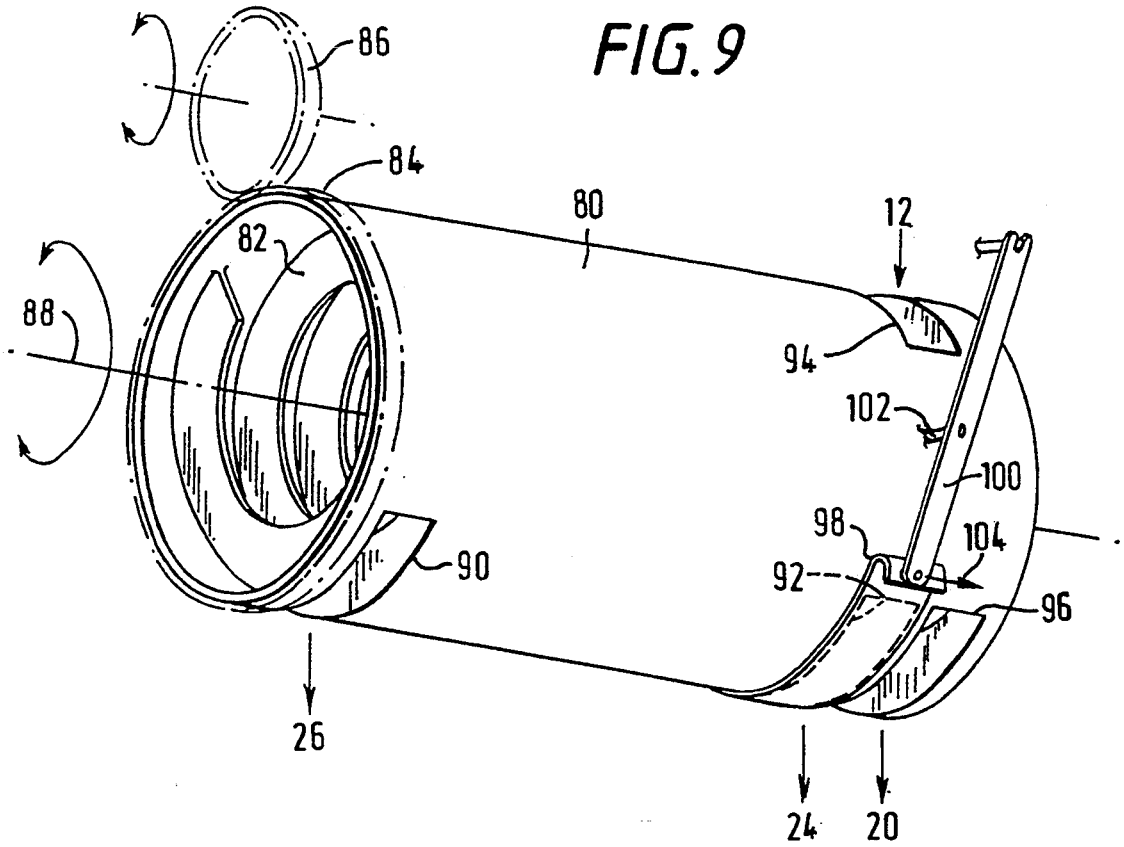
FIG. 9 is a perspective view of a coin store in a modified form of the invention.

With reference to FIG. 9, the store (16 or 18) comprises a hollow plastics cylinder 80 having on its inner surface an integrally-formed helical structure 82 extending radially inwardly therefrom.

At one end of the cylinder 80 there is formed a gear extending around the outer circumference, as schematically illustrated at 84. This meshes with a further gear 86 which is indirectly driven by a stepper motor (not shown). Accordingly, rotation of the stepper motor causes rotation of the cylinder 80 about its axis 88.

Figure 10:
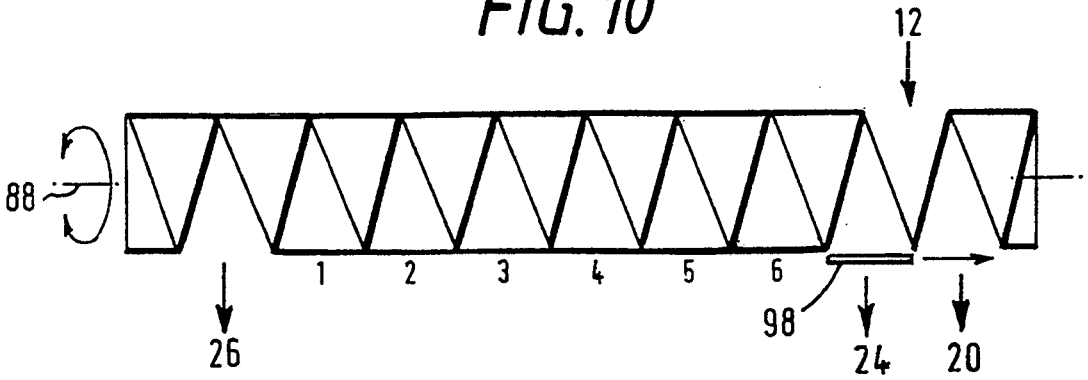
FIG. 10 schematically illustrates the storage locations in the store of FIG. 9.

The helical structure 82 defines nine compartments as schematically illustrated in FIG. 10, each compartment comprising the space between successive turns of the helical structure.

The left-most compartment has a permanently open slot 90 by means of which coins can pass from the store to the cash box path 26. The next six compartments, shown as 1 to 6 in FIG. 10, define the region in which the coins are normally stored during use of the device. The next compartment has an opening 92 leading to the cash box path 24 and, at the opposite side of the cylinder, an opening 94 leading to the coin entry path 12. The right-most compartment has an opening 96 leading to the refund path 20.

In this embodiment, there is only a single gate shown at 98. This is located beneath the opening 92 and is moveable by a lever 100 mounted for pivotal movement about a pin 102. Movement of the lever causes the gate 98 to move in the direction of arrow 104 so that it opens the cash box path 24 and moves beneath the opening 96 to close the refund path 20.

It will be understood that this is a much simpler structure. Nevertheless, it can be operated in a similar manner to that described with reference to FIG. 8. Normally, the gate 98 closes the cash box path 24 so that any incoming coin from the path 12 will rest on the gate. This is then moved to the left (in the orientation of the drawings) to allow room for further coins to enter. The compartments 1 to 6 can be gradually filled in this way. When it is desired to dispense a coin, the structure can be rotated to cause the coin at the left-most end of the stored group to be dispensed to cash box path 26. Alternatively, the gate 98 can be shifted away from the cash box 24, and the helical structure rotated in the opposite direction to dispense the right-most coin into cash box path 24. At the end of the transaction, the helical structure is turned so that the group of coins moves successively toward the right, and the gate 98 is controlled in dependence upon whether the coins are to be dispensed into path 24 or path 20.

It will be noted that fewer gates are needed, and there is no longer any need for an individual entry compartment located between the compartments leading to paths 20 and 24.

In the above embodiments, the control means 34 was required to memorise the denominations and locations of each of the coins in the stores. As an alternative, a store may have different areas designated for different denominations of coin, so that memorisation of the individual positions of inserted coins is no longer needed, so long as the positioning of the newly-inserted coins is controlled appropriately.

Instead of the helical member used in the above embodiment, other structural arrangements may be used for storing the coins. However, the helical member has the advantage that the coins within the store can be shifted without requiring translatory motion of the storage structure, i.e. simply by rotating it, so that the store may be housed in a small space. An alternative arrangement which avoids bodily translational movement of the support structure would be an endless conveyor belt having means defining compartments for receiving the coins. In any event, it is desirable for the storage structure to be such that the region within which a group of coins can reciprocate be completely fillable with coins, and/or for the overall volume occupied by the storage structure not to change as a result of the reciprocation of the coins. It is also preferred that a group of coins be reciprocable between spatially separate end positions, the reciprocation being preferably linear or substantially linear.

The term "coin" is intended herein to mean genuine coins, tokens, counterfeit coins, slugs, washers and any other such item.

We claim:

1. A coin handling apparatus comprising a coin store having first and second exit points wherein a group of coins of different denominations can be reciprocated with respect to the first and second exit points, a cash retention means, means located in relation to the first and second exit points for conveying coins exiting therefrom to the cash retention means, whereby at each exit point a coin of any of said denominations can be taken away from the group and delivered to the cash retention means, and control means controlling the sequence in which coins are delivered to the cash retention means by selectively moving the coin group in one direction to dispense a coin from the first exit point, and the opposite direction to dispense a coin from the second exit point.

2. A coin handling apparatus as claimed in claim 1, wherein the coin store further comprises support means for supporting and reciprocating a group of coins without corresponding bodily translational movement of the support means.

3. A coin handling apparatus as claimed in claim 1, wherein the coin store further comprises a helical structure having successive turns between which the coins are, in use, located, so that the coins can be supported and can be moved by rotation of the structure.

4. A coin handling apparatus as claimed in claim 1, wherein the exit points of the coin store are located at respective ends of a region in which the coins can be stored, and within which the group of coins can be reciprocated when the region is not filled with coins, whereby each endmost coin of such a group can be selectively removed at the first or second exit point.

5. A coin handling apparatus as claimed in claim 4, wherein the coin store further comprises an entry point at or adjacent one of the ends of the region whereby a further coin can be added to an end of the group.

6. A coin handling apparatus as claimed in claim 4, further comprising a refund passage, wherein the coin store further comprises a third exit point for delivering coins to the refund passage, the second and third exit points both being located at an end of the region so that the coins can be moved in succession to one of the second and third exit points and either dispensed therefrom or moved on to the other of the second and third exit points for dispensing.

7. A coin handling apparatus as claimed in claim 4, further comprising a refund passage, wherein the coin store further comprises gate means for selectively directing coins from one of the exit points to the refund passage instead of to the cash retention means.

8. A coin handling apparatus as claimed in claim 1, wherein the coin store further comprises gate means for selectively enabling or inhibiting at least one of said exit points.

9. A coin handling apparatus as claimed in claim 6, wherein the coin store further comprises gate means movable from a first position in which it blocks the second exit point to a second position in which it blocks the third exit point.

10. A coin handling apparatus as claimed in claim 1, wherein the coins in the coin store are positioned in a face-to-face orientation.

11. A coin handling apparatus as claimed in claim 1, wherein the coin store is arranged to store coins individually in respective separated locations.

12. A coin handling apparatus as claimed in claim 1, the control means being arranged to cause coins to be dispensed from the coin store in a different sequence from that in which they are delivered to the store.

13. A coin handling apparatus as claimed in claim 1, the control means being arranged to select a coin for dispensing from the coin store in dependence on the denomination thereof.

14. A coin handling apparatus as claimed in claim 13, wherein the selection of the coin to be dispensed from the coin store is dependent also on the position of the coin.

15. A coin handling apparatus as claimed in claim 1, further comprising a coin validator for receiving coins, determining their denominations, and delivering them to the coin store.

16. A coin handling apparatus as claimed in claim 15, further comprising a refund path wherein coins from the store can be selectively directed to the refund path or the cash retention means.

17. A coin handling apparatus as claimed in claim 15, the system comprising at least two stores for receiving coins from the validator.

18. A coin handling apparatus as claimed in claim 17, including means for selecting the store to which coins are directed from the validator in accordance with the denomination of the coin.

19. A coin handling apparatus as claimed in claim 17, wherein the control means causes a selected one of the coins in the stores to be dispensed in dependence upon the values of coins in both stores.

20. A coin handling apparatus as claimed in claim 17, including means for sensing a fault condition in either of the stores, and for causing further coins to be directed to the other store in response thereto.

21. A method of controlling a coin handling system having a coin validator for use with coins of a range of denominations and at least two coin stores, the arrangement being such that the system can deliver to each of the stores coins of a plurality of said denominations for storage therein, the method comprising selecting the store to which coins are to be delivered in dependence upon the values of the coins, storing in a first of the stores coins of a plurality of denominations which are predominantly low-denomination coins, storing in a second of the stores coins of a plurality of denominations which are predominantly high-denomination coins, the coins being stored within each coin store without segregating the coins by denomination, and selectively dispensing coins from each of the two stores to a cash retention means based on the denomination of the coins.

22. A method as claimed in claim 21, including the step of detecting a fault condition in one of the stores, and in response thereto causing further coins of denominations which would normally cause them to be directed to that store to be directed instead to a different one of said stores.

* * * * *